US006826807B2

(12) United States Patent
Inoue et al.

(10) Patent No.: US 6,826,807 B2
(45) Date of Patent: Dec. 7, 2004

(54) FASTENER

(75) Inventors: Teruo Inoue, Tokyo (JP); Masahiro Kusayama, Toyama-ken (JP); Nigel Berry, Cheshire (GB); Hideki Terashima, Fukui-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/295,179

(22) Filed: Nov. 15, 2002

(65) Prior Publication Data

US 2003/0093885 A1 May 22, 2003

(30) Foreign Application Priority Data

Nov. 21, 2001 (JP) ..... 2001-356229

(51) Int. Cl.[7] ..... A44B 19/00; A44B 17/00; A44B 18/00

(52) U.S. Cl. ..... 24/381; 24/306; 24/442

(58) Field of Search ..... 24/381, 395, 393, 24/394, 397, 398, 403, 405, 41

(56) References Cited

U.S. PATENT DOCUMENTS 4,527,383 A * 7/1985 Bingham ..... 57/200
4,892,336 A * 1/1990 Kaule et al. ..... 283/91
5,607,621 A * 3/1997 Ishihara et al. ..... 252/301.36
5,956,818 A * 9/1999 Tsubata ..... 24/397
6,139,774 A 10/2000 Yamada et al.
6,180,545 B1 * 1/2001 Okeya et al. ..... 442/308

FOREIGN PATENT DOCUMENTS

JP 2001-211913 8/2001
WO WO 99/63145 12/1999

OTHER PUBLICATIONS

"Patent Abstracts of Japan", vol. 1995, No. 07, Aug. 31, 1995 (JP 07 092911 A, Apr. 7, 1995).
"Patent Abstracts of Japan", vol. 2000, No. 25, Apr. 12, 2001 (JP 2001–211913 A, Aug. 7, 2001).

* cited by examiner

*Primary Examiner*—Robert J. Sandy
(74) *Attorney, Agent, or Firm*—Michael S. Leonard; Everest Intellectual Property Law Group

(57) ABSTRACT

A fastener which allows to distinguish a genuine fastener from a forged one. An identification yarn containing substance with different optical reactions to irradiation of visible light and to irradiation of infrared rays of a specific wavelength is disposed at a specified position in the tape which is a component of the fastener. As a result, discrimination between genuine and false fasteners can be done safely without damaging the human health.

9 Claims, 8 Drawing Sheets

FASTENER

BACKGROUND OF THE INVENTION

1. Field of the Invention

The present invention relates to a fastener having a structure which helps to distinguish whether a fastener such as a slide fastener, a surface fastener and a snap fastener is genuine or false.

2. Description of the Related Art

The fastener includes a slide fastener, a surface fastener, a snap fastener and the like, which are widely used to fix mating members detachably in various kinds of clothes, small articles such as bags, and large structures such as tents and pavilions. A large number of imitation fasteners having an equal brand indication have been produced and marketed at cheaper prices, because the fastener is versatile and its demand is high. Part of the imitation fasteners are attached to various kinds of products such as clothes and those products having the imitation fastener are often dealt with in distribution channels of the products.

As processing technology and manufacturing technology for fabric products advance and quality of raw material intensifies, the imitation product comes to closely resemble the genuine product, and the imitation product cannot be easily identified from the genuine product in many cases. As a result, a large number of imitation products are dealt with and sold through the same distribution channel without being identified from the genuine products, so that the share of the genuine products in the market drops, and manufacturers of the genuine products are threatened seriously.

Currently, the manufacturers have made efforts to distinguish genuine products from imitation products by marking their brand marks in the slider portion of the slide fastener or in peripheral portions of the snap fastener or by weaving their brand marks into part of the tape constituting the fastener. Moreover, they have requested national governments to regulate such imitation products.

Despite these efforts and activities, the number of imitation products does not decrease and manufacturers of the imitation products have produced imitation products resembling the genuine products more closely by using the brand names without any permission and marking them thereon.

As means for distinguishing the genuine product from the imitation product, Japanese Patent Application Laid-Open No. 13-211913, for example, has disclosed a slide fastener which can be identified from the imitation product. According to the slide fastener disclosed in this publication, a filament yarn, which is formed by mixing inorganic fluorescent material into high polymer raw material and fusing and spinning said raw material, is employed as an identification yarn and this identification yarn is woven in a cloth tape as a warp yarn when the cloth tape of this slide fastener is woven. Although this identification yarn does not emit light against irradiation of sunlight or fluorescent light, the fluorescent material in the identification yarn emits light if excitation light of 254 nm or 365 nm, which is the wavelength of black light, is applied to the slide fastener. The genuine product can be distinguished from the imitation product by weaving this identification yarn into the genuine slide fastener as its warp yarn.

However, the slide fastener described in the same publication requires black light belonging to ultraviolet as a light source for making inorganic luminescent substance emit light. Moreover, ultraviolet rays need to be irradiated all over the slide fastener in order to detect existence of the identification yarn, because the position of the identification yarn in the slide fastener is not specified. Ultraviolet rays are said to be a factor of skin cancer, thus exposure to ultraviolet rays for a long time is harmful for the health even if it is for inspection for discriminating between the genuine and imitation products, and the working environment is deteriorated. Furthermore, the identification yarn may emit light under the sunlight because it contains a great deal of ultraviolet rays, so that the manufacturers of the imitation products recognize existence of the identification yarn.

Moreover, when a dye with a fluorescent color is used for dyeing the tape, the entire tape reacts to ultraviolet rays when ultraviolet rays are irradiated to the tape. Therefore, a detecting means substituting for ultraviolet rays is demanded.

An object of the present invention is to prevent reaction of the entire tape to irradiated ultraviolet rays and provide a fastener which can be distinguished from a closely imitated product without using ultraviolet rays which harm the human health.

SUMMARY OF THE INVENTION

According to the present invention, at least one identification yarn is disposed at no fewer than one specified position in a tape composing a genuine fastener, so that the identification yarn can be detected when the tape is irradiated with infrared ray of a specific wavelength, though existence of the identification yarn cannot be recognized in an ordinary state such as under visible light.

That is, the basic structure of the present invention is a fastener such as a slide fastener, a surface fastener, or a snap fastener, which comprises said identification yarn for distinguishing a genuine fastener from a false one by irradiating at least a specified part of a tape composing said fastener with infrared rays with a specific wavelength.

In the tape composing the genuine slide fastener such as the slide fastener, surface fastener and snap fastener of the present invention, said identification yarn is used as part of the composing yarns of the knitted or woven tape. Said tape is a common composing member of all these fasteners and has an identifying portion. Therefore, despite structural difference of each fastener, genuine fasteners can be distinguished from imitation ones accurately in all above-mentioned fasteners.

Substance having a spectral characteristic under irradiation with infrared ray of a specific wavelength, said characteristic different from under white light, or substance emitting infrared rays when irradiated with infrared rays is contained in said identification yarn. As a result, existence of the identification yarn can be detected easily through characteristic change of the substance contained in said identification yarn when infrared rays of a specific wavelength are irradiated.

When the tape constituting the slide fastener, surface fastener or snap fastener is dyed, for example, white, white fluorescent dye is generally used so as to make the white color clear. Thus, when said identification yarn which emits color when irradiated with ultraviolet rays is used, if the tape is dyed with the fluorescent dye, the tape itself emits color because the fluorescent dye contains substance which emits the color when irradiated with ultraviolet rays. Consequently, the identification yarn cannot be detected. However, according to the present invention, the substance which reacts not to irradiation of ultraviolet rays but to infrared rays of a specific wavelength is contained in said identification yarn. Thus, even if the tape is dyed with fluorescent dye, said identification yarn can be identified definitely.

Preferably, the tape is a woven tape whose component yarns are a plurality of warp and weft yarns. Said identification yarn is a warp yarn, and repeats a cycle of intersecting and running above one or two weft yarns and then intersecting and running below one or two weft yarns. If said identification yarn intersects and runs above or below three or more weft yarns, the identification yarn floats from a surface of the tape so as not to be fixed to the tape securely. Thus, the number of the weft yarns which said identification yarn intersects is preferably one or two.

The above-described structure can minimize the amount of the expensive identification yarn to be used. Thus, increase in production cost of the fastener by using expensive identification yarns as part of the component yarns of the tape can be held down. Further, because said identification yarn is fixed to the tape securely and the ratio of exposure of the identification yarn from the surface is increased, existence of the identification yarn can be easily recognized from the surface of the tape when irradiated with infrared rays.

Additionally, as for the intersection between said identification yarn and the weft yarn, the number of the weft yarns intersecting and running above/below said identification yarn may be changed properly. For example, the identification yarn can intersect and run above two weft yarns, then below one weft yarn, above one weft yarn and then below two weft yarns. By changing the number of the weft yarns intersecting and running above/below the identification yarn, a pattern may be formed or the weaving pattern of the identification yarn may be used for transmitting information as Morse code does. By properly changing the number of the weft yarns intersecting and running above/below said identification yarn, the identification yarn can be used not only to distinguish the genuine product from a false one but also to indicate the place or date of the production of the tape.

Furthermore, the above-mentioned tape is a knitted tape whose component yarns are plural kinds of warp knitting yarns, and said identification yarn may be a warp in-laid yarn inserted along a chain-stitch knitting yarn, a chain-stitch knitting yarn, or a tricot-stitch knitting yarn. The amount of the identification yarn to be used can be minimized as in the above-described woven tape. Thus, increase in production cost of the fastener by using an expensive identification yarn as part of the component yarns of the tape can be held down. Further, because said identification yarn is fixed to the tape securely and the ratio of exposure of the identification yarn from the surface is increased, existence of the identification yarn can be easily recognized from the surface of the tape when irradiated with infrared rays.

Preferably, said specified position is adjacent to a leg portion end of an element row of the slide fastener, the identification yarn is a warp yarn or a warp knitting yarn and is disposed continuously along the position adjacent to the leg portion end. In this way, the position of said identification yarn is specified in the slide fastener. Therefore, when searching for existence of the identification yarn by irradiating with infrared rays of a specific wavelength, the infrared ray does not have to be projected to the entire tape, and existence of the identification yarn can be recognized easily. Further, since said identification yarn is disposed near the elements, even after the slide fastener is sewed to clothes, the identification yarn is not covered by fabric of the clothes so that the identification yarn can be recognized easily.

Preferably, said identification yarn is dyed the same color as that of the other component yarns of the tape. If said identification yarn is dyed the same color as that of other weaving yarns or knitting yarns composing the tape, existence of the identification yarn woven or knitted in the tape cannot be recognized apparently. Consequently, weaving or knitting of the identification yarn cannot be imitated even if an imitation product is manufactured to precisely resemble the genuine product. Therefore, discrimination between the genuine product and the imitation product can be carried out accurately. Particularly, if a weaving or knitting pattern of the identification yarn is specified, forgery becomes more difficult. Furthermore, depreciation of the commodity value of the fastener due to apparent existence of the identification yarn is avoided because existence of the identification yarn cannot be recognized apparently.

In a tape in the surface fastener, said identification yarn can be a part of yarns used as hook-like or loop-like engaging elements. In the surface fastener, an engaging element yarn, which is a tape-component yarn, is used for the identification yarn and erects from a tape surface. Consequently, infrared rays can be irradiated to the yarn easily, and existence of the yarn can be recognized smoothly.

Preferably, said identification yarn contains substance which emits a color different from surrounding components when irradiated with infrared rays. Since the identification yarn emits a color different from the surrounding components when irradiated with infrared ray, existence of the identification yarn can be explicitly recognized by the eyes. In addition, said identification yarn can contain substance which emits infrared rays when irradiated with infrared rays. Since the identification yarn emits infrared rays when irradiated with infrared rays, if, for example, a device which beeps at the same time when an infrared sensor detects infrared rays is used, existence of the identification yarn can be explicitly recognized by hearing.

DESCRIPTION OF THE PREFERRED EMBODIMENTS

Hereinafter, the preferred embodiments of the present invention will be described in detail with reference to the accompanying drawings.

Figure 1:
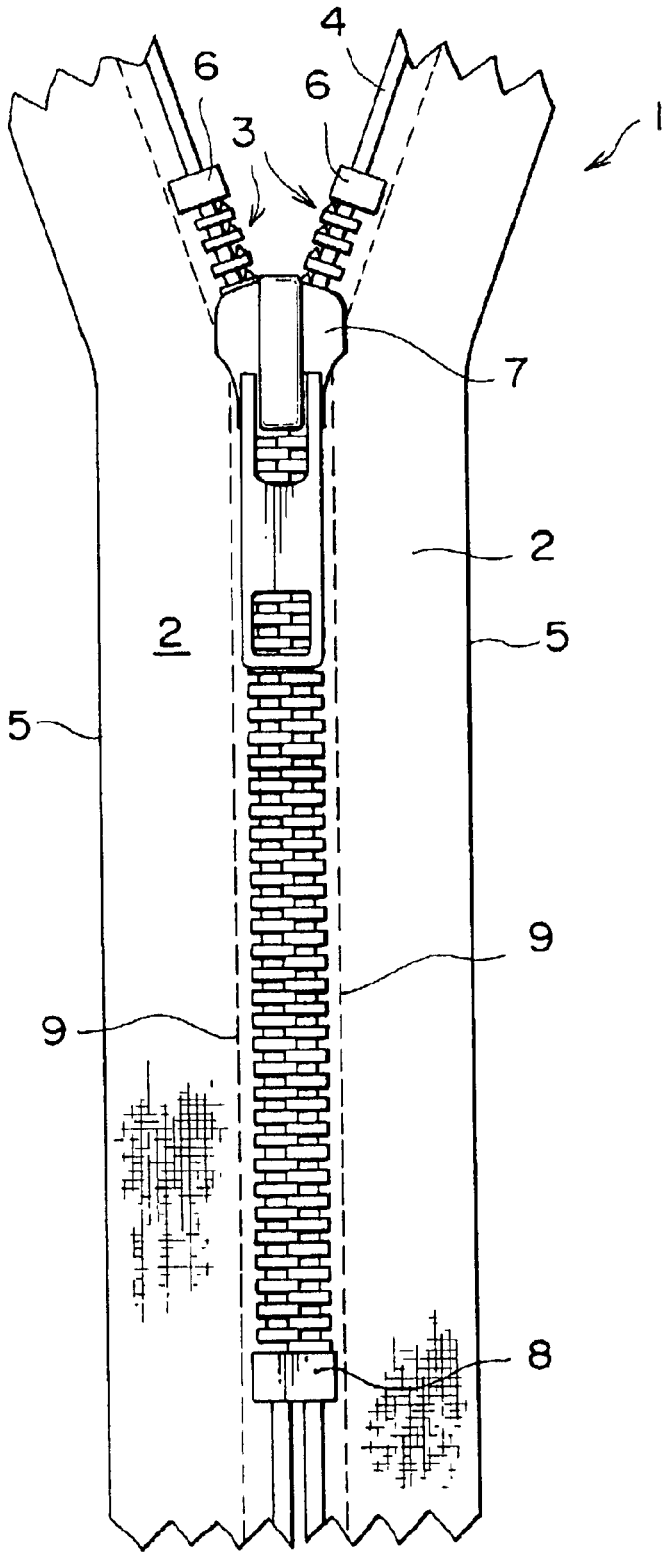
FIG. 1 is a schematic plan view of a slide fastener according to a typical embodiment of the present invention.

FIG. 1 is a schematic view of a slide fastener. Generally, a pair of fastener tapes 2 of the slide fastener 1 is composed of woven or knitted fabric tapes. In the slide fastener of the present invention, the identification yarn is used as part of the warp yarns of the fabric tapes.

In the slide fastener, a fastener element row 3 is provided along each of opposing side edges in the pair of the fastener tapes 2. An upper stop end portion 6 is provided at the upper stop end portion of each fastener element row 3 while a bottom stop end portion 8, which couples both bottom end portions so that said bottom end portions may not disengage from each other, is provided at the bottom end portion of each fastener element row 3. A slider 7, which can engage or disengage the fastener elements, is disposed so that it can slide between the upper stop end portion 6 and the bottom stop end portion 8.

In the meantime, separable bottom stop end can be used instead of the bottom stop end portion, said bottom stop end comprising an insert pin, a box pin and a box body, and capable of separating said bottom end portion.

Figure 2:
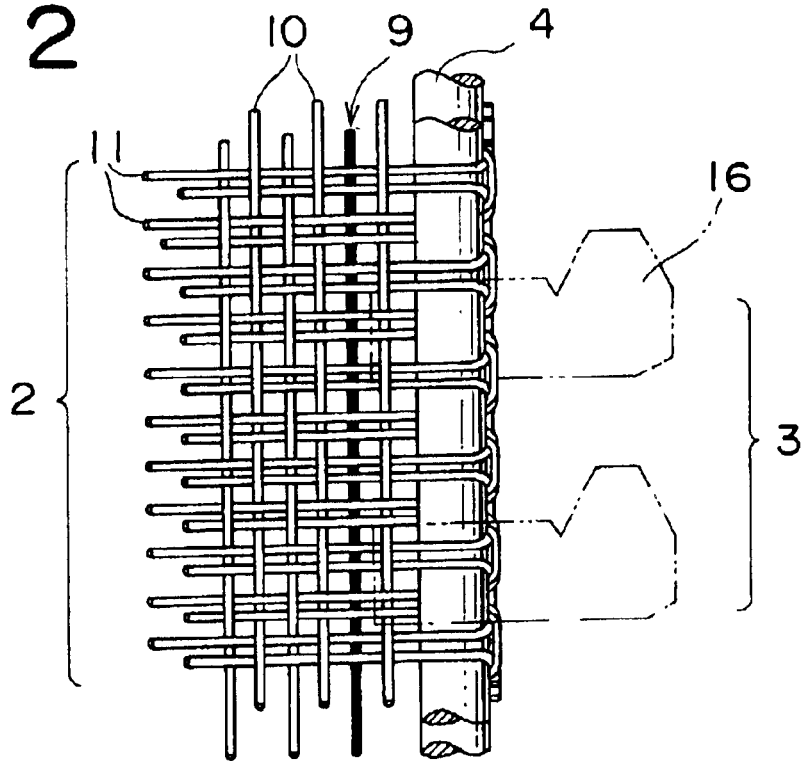
FIG. 2 is a partial plan view showing an example of a woven tape of a slide fastener.
Figure 3:
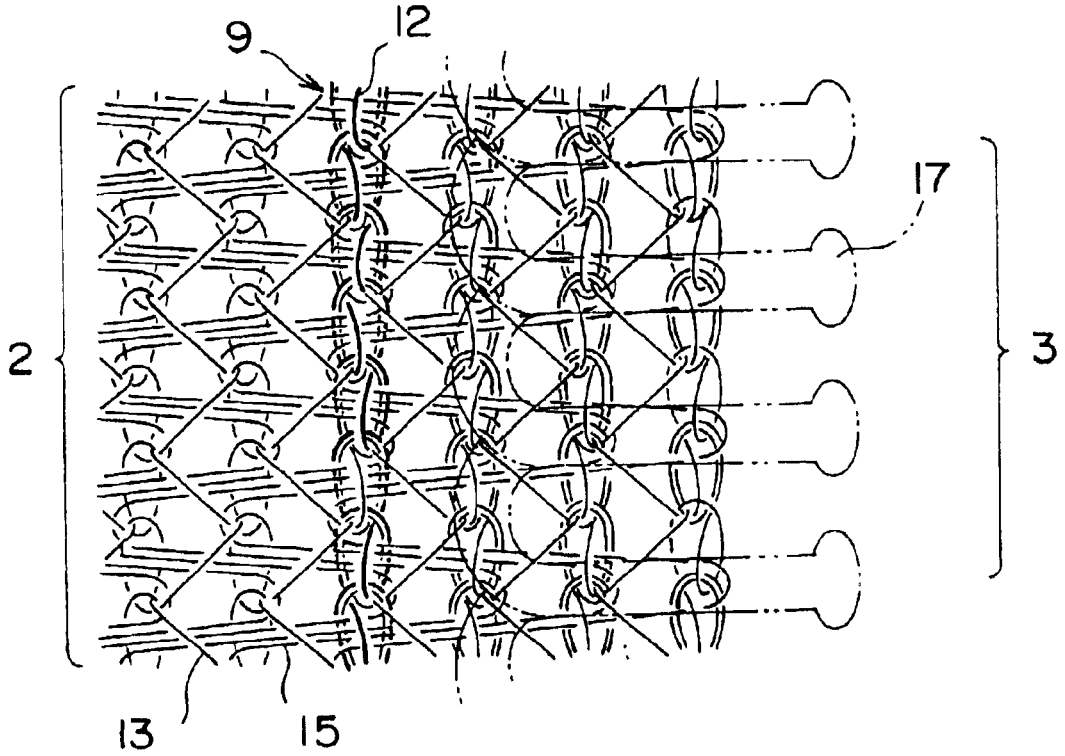
FIG. 3 is a partial plan view of a slide fastener tape in which fastener elements are knitted.
Figure 4:
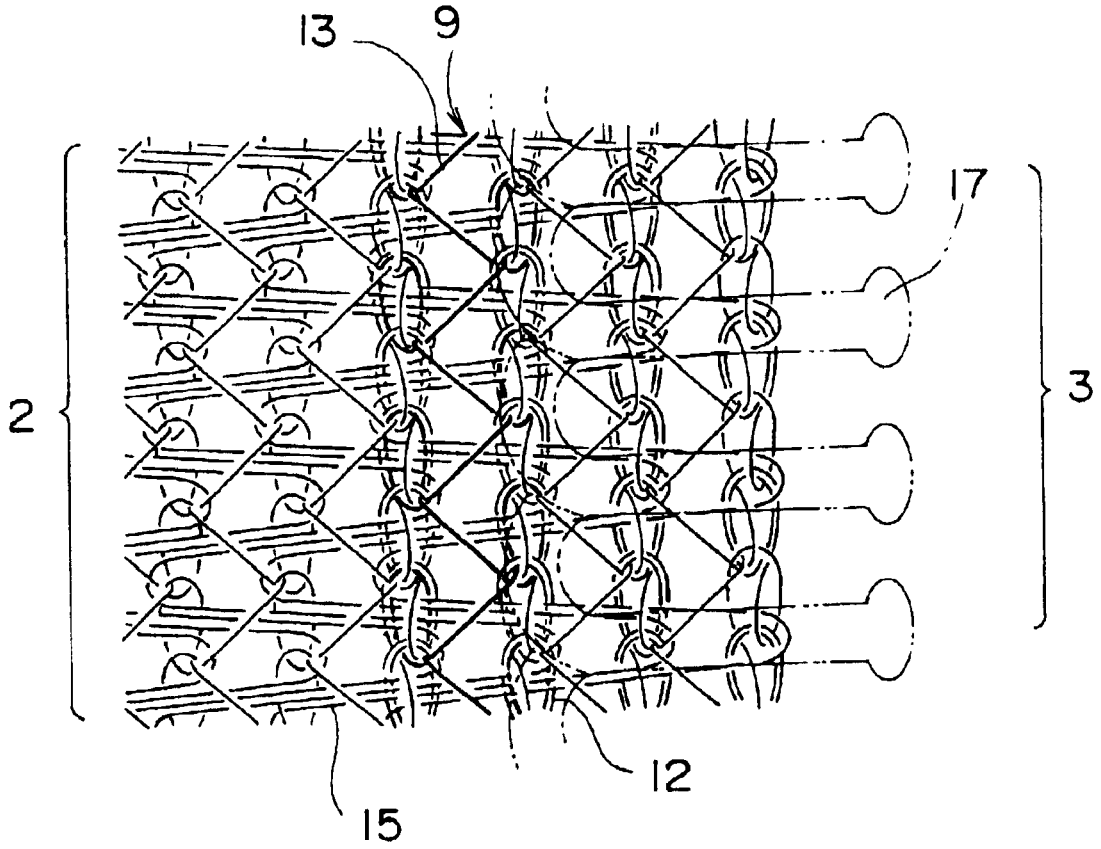
FIG. 4 is a partial plan view of a slide fastener tape in which a tricot yarn is used as the identification yarn.
Figure 5:
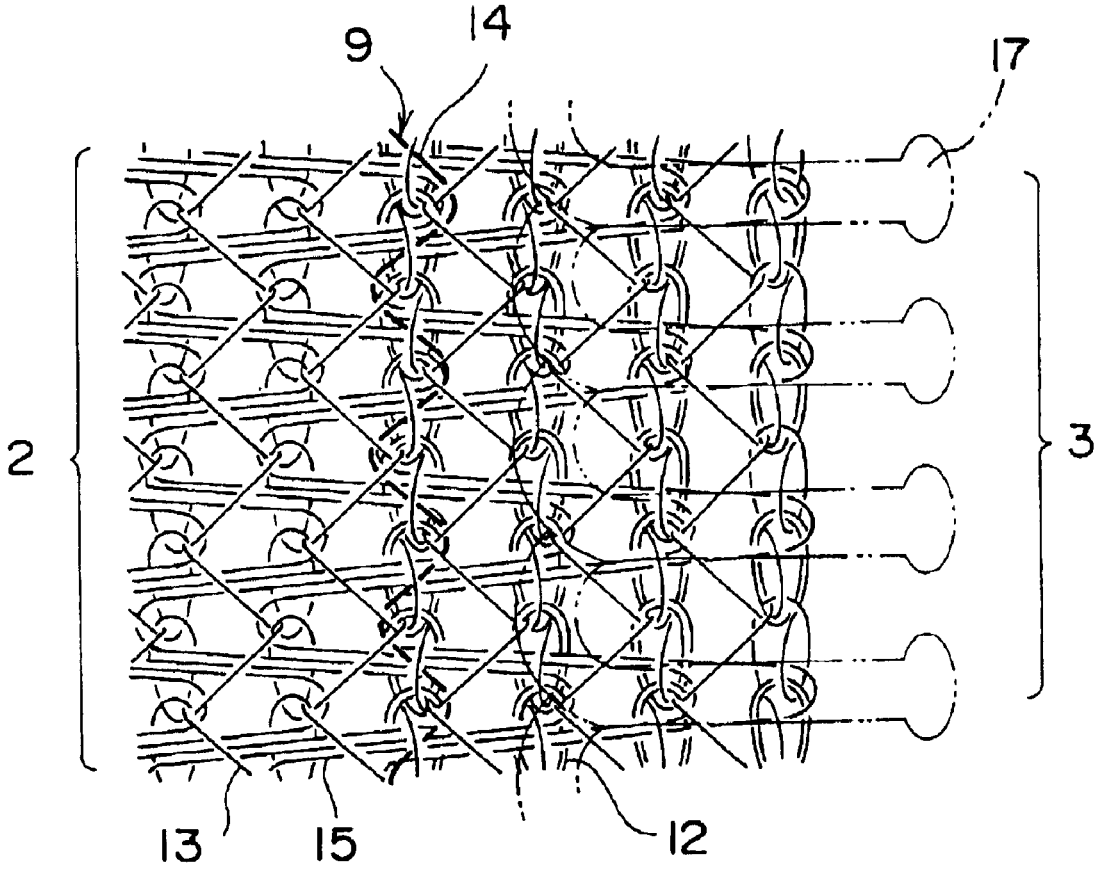
FIG. 5 is a partial plan view of a slide fastener tape in which a warp in-laid yarn is used as the identification yarn.

As shown in FIG. 2, the fastener element row 3 comprises a plurality of metallic fastener elements 16 and fixed at equal intervals by being fastened to a core portion 4 formed along the side edge of the fastener tape 2 woven with warp yarns 10 and weft yarns 11. As shown in FIGS. 3 to 5, the fastener element row 3 comprises continuous coiled fastener elements 17. This fastener element row 3 is fixed by being sewn with sewing thread along the side edge of the fastener tape 2 knitted with plural kinds of knitting yarns such as chain-stitch knitting yarns 12, tricot-stitch knitting yarns 13, warp in-laid yarns 14, and weft in-laid yarns 15.

The fastener element is not restricted to the above-described examples, and plural synthetic resin fastener elements can be formed by injection molding on the core portion at equal intervals.

Further, the combination of the fastener elements and the fastener tape is not restricted to the above-described examples, and various combinations can be produced depending on the use of the slide fastener. That is, metallic, synthetic resin or coiled fastener elements can be fixed by fastening, injection molding or sewing to a woven or knitted fastener tape or can be woven or knitted to the fastener tape at the same time when said fastener tape is woven or knitted.

A position where the identification yarn 9 is disposed can be adjacent to leg portions of the element row 3, as shown in FIGS. 1 to 5. The fastener tape 2 shown in FIG. 2 is a woven tape comprising the warp yarns 10 and the weft yarns 11. The weft yarns 11 are inserted by a needle narrow weaving machine of a type in which a carrier bar (not shown) is reciprocated (double picks) through a shuttle road in a warp yarn opening and therefore, two weft yarns are arranged in parallel. The warp yarns 10 run repeatedly above the weft yarns 11 and then below next weft yarns 11. Then, adjacent warp yarns 10 run above/below the weft yarns 11 deflected by one pitch in the running direction.

Here, part of the warp yarns 10 in the fastener tape 2 is used as the identification yarn 9. The identification yarn 9 runs repeatedly above/below the weft yarns 11 like other warp yarns 10, and is woven such that it cannot be distinguished from other warp yarns 10 apparently. The running of the warp yarns 10 is not restricted to the above-described embodiment, and said warp yarns 10 may repeat running above two weft yarns and below one or two weft yarns. In this case, it is preferable that one identification yarn 9 runs in parallel to and together with one warp yarn 10.

The fastener tapes 2 shown in FIGS. 3 to 5 are knitted tapes composed of plural kinds of warp knitting yarns. The warp knitting yarns include chain-stitch knitting yarns, tricot-stitch knitting yarns, warp in-laid yarns, weft in-laid yarns, two-needle stitch yarn and the like. More specifically, as shown in FIGS. 3 to 5, all wales of the fastener tape 2 are composed of tricot-stitch knitting yarns of 1-2/1-0 and chain-stitch knitting yarns 12 of 0-1/0-1 are knitted into four wales on an edge portion side to which the fastener elements 17 are to be attached. Weft in-laid yarns 15 of 0-0/4-4 are disposed between the wales. In the meantime, the chain-stitch knitting yarns may be knitted into wales on an edge portion side opposite to the edge portion side to which the fastener elements are to be attached, as in the wales on the edge portion side to which the fastener elements are to be attached.

In FIG. 3, the identification yarn is used as part of the chain-stitch knitting yarns 12 in a row of the wale. Meanwhile, in an example shown in FIG. 4, the identification yarn 9 is used as part of the tricot-stitch knitting yarns 13.

FIG. 5 shows an example in which the identification yarn 9 is used as the warp in-laid yarn 14. Although the identification yarn 9 is located adjacent to the leg portions of the fastener elements 17, said identification yarn 9 may be used as a knitting yarn hooked on the fastener elements 17. In addition, the identification yarn 9 can be used, as part of component yarns composing an ear portion 5 of the fastener tape 2. The identification yarn 9 needs to be located at a position which can be specified on the slide fastener 1. In addition, the identification yarn 9 needs to be located at a position which can be recognized without damaging the clothes or the like even if the slide fastener 1 is already mounted on them.

Figure 6:
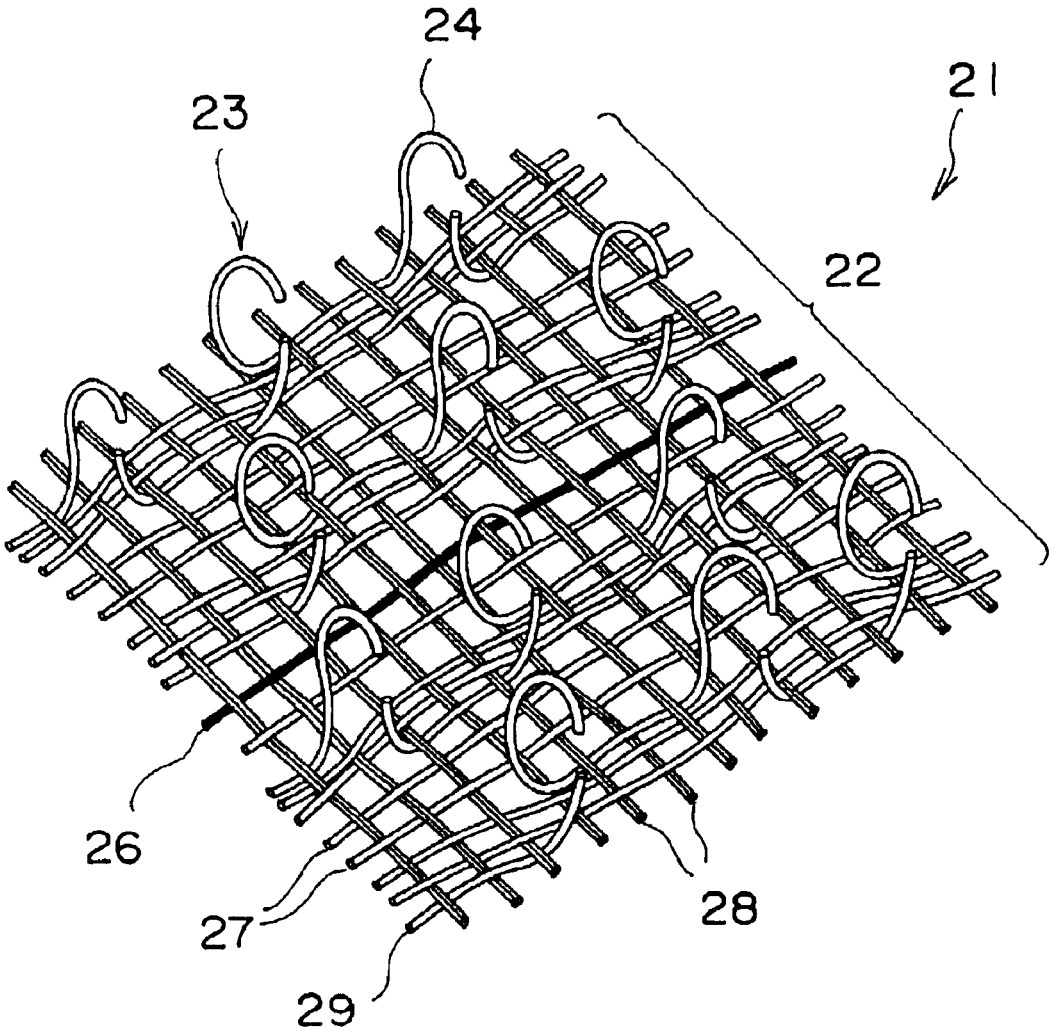
FIG. 6 is a partial perspective view of a surface fastener according to another embodiment of the present invention.
Figure 7:
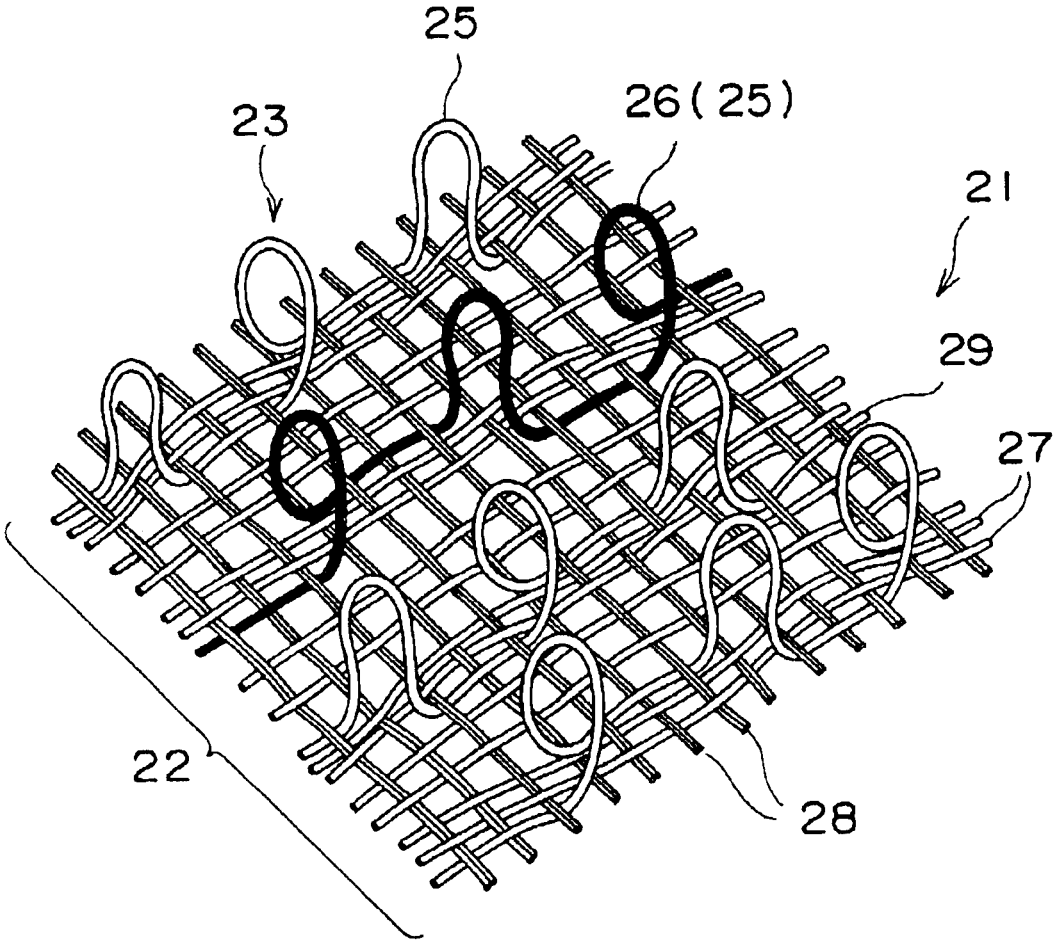
FIG. 7 is a partial perspective view of a surface fastener in which part of engaging elements is used as the identification yarn.

FIGS. 6 and 7 are schematic views showing part of the surface fastener. A tape of the surface fastener 21 comprises warp yarns 27, weft yarns 28 and engaging element yarns 29. The engaging element yarns 29, which are made of monofilaments or multi-filaments, are woven into a foundation cloth 22 composed of the warp yarns 27 and the weft yarns 28. The same engaging element yarns 29 erect from the surface of the foundation cloth 22 so as to form engaging elements 23 composed of a plurality of hooks 24 or loops 25. The identification yarn 26 is used as part of the above-described component yarns.

The identification yarn 26 can be disposed at ear portions on both sides of the foundation cloth 22 or in a central position between the ear portions.

Figure 8:
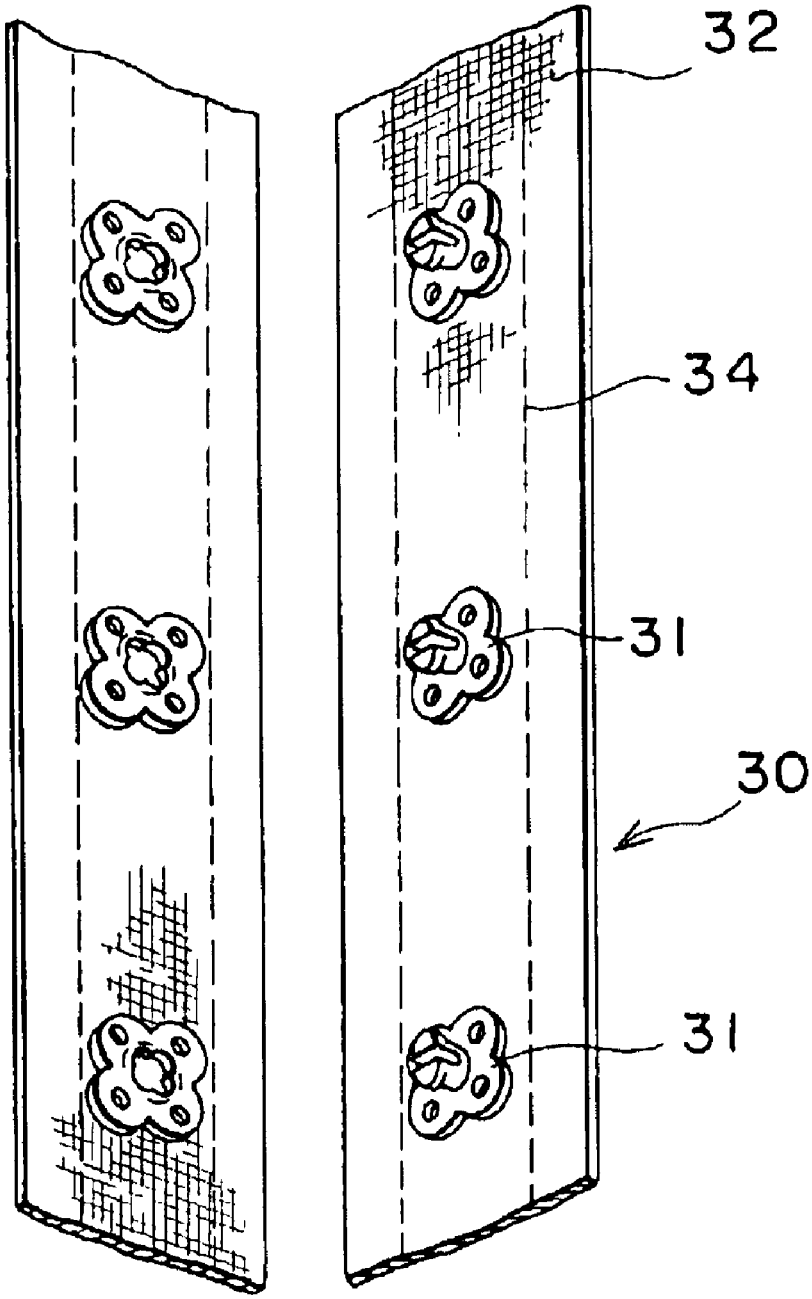
FIG. 8 is a disassembly perspective view of a snap fastener in which identification yarns are disposed.

FIG. 8 shows tapes 32 holding snap elements 31 of a snap fastener 30. The tapes 32 are formed as woven or knitted fabric tapes.

Identification yarns 34 are disposed near the snap elements 31 as warp yarns or a warp knitting yarns of the woven or knitted tape 32. The identification yarns 34 may be formed not only at the above-mentioned position but also in the tape 32 as a hidden mark.

In the meantime, the tape in the slide fastener, surface fastener and snap fastener of the present invention does not cover a label sewed on a product, an ornamental tape attached to a shoulder portion or cuff of sportswear or a wrapping tape used for wrapping a commodity.

Figure 9A:
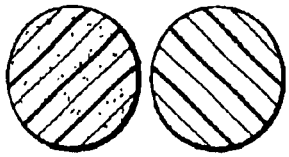
FIG. 9 is an explanatory diagram of the structure of the identification yarn.
Figure 9B:
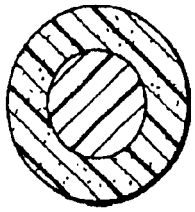
Figure 9C:
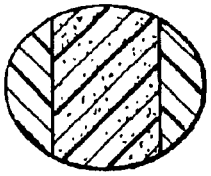
Figure 9D:
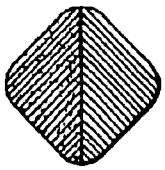
Figure 9E:
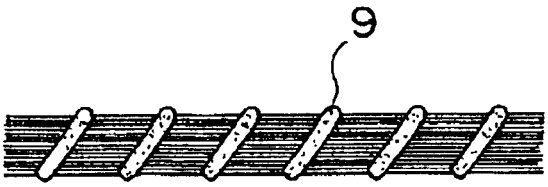

As for the structure of the identification yarn 9, 26, 34, the identification member can be formed as shown in FIGS. 9A to 9E. The identification yarn can be formed by twisting one or more spun filaments to which identifying substance is mixed. If the filaments cannot be used simply by twisting one or more filaments with respect to their strength, the filaments can be twisted with other ordinary fibers or winded around the other fibers as shown in FIG. 9E. A sectional shape of the filament can be quadrilateral, diamond, elliptic and the like as shown in FIG. 9D as well as circular as shown in FIGS. 9A to 9C.

As for the filament, a core/sheath composite yarn can be produced by compounding polyester polymer, into which identifying substance is mixed, inside transparent nylon as a core portion as shown in FIG. 9B. Further, as shown in FIGS. 9C and 9D, polymer into which identifying substance is mixed can be sandwiched by ordinary polymer or vice versa, or these different polymers can be bonded together.

Polyester, vinylon, nylon, cellulose acetate, acetate, rayon, acrylic or the like, which are widely known, can be used as polymer composing the yarn.

When the identification yarn is woven or knitted in the tape, it can be used as a yarn for ordinary weaving machine or knitting machine and does not require any special devices.

The identifying substance must be excited by irradiation of infrared rays with the wavelength of 780 nm to 1.5 $\mu$m, developing such colors as blue, green, red, orange and yellow and having little persistence characteristic, or emitting infrared rays. The particle diameter of the substance is preferred to be 3 $\mu$m or less. Green or yellow green is preferred as the color developed by irradiation of infrared rays. Particularly, when the fastener tape is dyed deep color such as black or red, existence of the identification yarn can be recognized easily by the eyes if the identification yarn develops green or yellow green. Further, if the color emitted by the identifying substance is determined depending on production place, period or the like of the identification yarn, the place and the period of production can be recognized by the emitted color.

Inorganic substances to emit visible light under infrared-ray irradiation, which can be used as identifying substance, include europium base compound, samarium base compound, zinc sulfide base compound, zinc oxide base compound, zinc silicate and the like.

As substances which emit infrared rays, $LiAlO_2$:Fe, (ZN, CD)S:Cu, $YVO_4$:Nd and the like are available and they can be mixed together for use.

Optically active elements to infrared rays contain iron (Fe) and erbium (Er), and can further contain at least one element of scandium (Sc), gallium (Ga), aluminum (Al), iridium (In), yttrium (Y), bismuth (Bi), cerium (Ce), gadolinium (Gd), lutecium (Lu), and lanthanum (La).

As inorganic fluorescent substance to emit light under infrared-ray irradiation, such rare earth elements as europium (Eu), neodymium (Nd), ytterbium (Yb), thulium (Tm), praseodymium (Pr) and dysprosium (Dy) can be used. Or, inorganic compound of fluoride or oxide, such as phosphate, molybdate and tungstate, which contain a mixture of above-mentioned rare earth elements as a luminescence center can be used. More specifically, an inorganic compound such as NdP5014, LiNdP4012, NaY0.69Yb0.3, and Er0.01F4 or their mixture can be used.

For example, in an inorganic fluorescent substance of calcium sulfide (CaS) containing a very small amount of europium and samarium (Sm), europium absorbs light and transfers electrons to samarium, thereby storing energy inside. If this substance is irradiated with infrared rays in this condition, electrons stored in samarium are returned to europium so as to emit visible light. This inorganic fluorescent substance always absorbs surrounding light and stores energy inside. When irradiated with infrared rays, the inorganic fluorescent substance is excited so as to discharge the stored energy in the form of visible light. This substance converts infrared rays to visible light effectively.

Further, an inorganic compound can be adhered to a liquid organic compound which emits visible light when irradiated with infrared rays, mixed with resin powder containing the organic compound, or added with an inorganic substance absorbing infrared rays of a specific wavelength.

Preferably, the identifying substance is added by about 0.1 to 10 weight percent to polymer to be spun. It can be added by about 2 to 4 weight percent if the synthetic fiber yarn is dyed light color and about 4 to 10 weight percent if dyed deep color. When the identifying substance is added by about 0.1 to 1 weight percent to the polymer to be spun, infrared rays of a specific wavelength can be detected easily when an alarm or a light-emitting device described below is used. The particle diameter is preferred to be very small. If the average particle diameter is 2 to 3 $\mu$m and about 95% of particles have diameters of 7 $\mu$m or less, spinning without breakage of yarn is possible.

The identification yarn containing the identifying substance can be dyed in a predetermined color by using dip dyeing method or the like with organic pigment. Further, the tape can be dyed with organic pigment after a tape in which the identification yarn is woven or knitted is produced.

In the fastener produced according to the present invention, the identification yarn cannot be recognized in an ordinary state such as under the sunlight or fluorescent light, and the identification yarn can be detected only with specific detecting means. Therefore, under ordinary condition, this fastener can be handled like a fastener having no identification yarn.

However, existence of the identification yarn can be detected easily by irradiating a fastener with infrared rays of a specific wavelength by using a commercially available infrared laser, an infrared ray LED or the like. Further, infrared rays of a specific wavelength emitted from the identification yarn due to irradiation of infrared rays of a specific wavelength can be detected with an excitation-detecting couple using an infrared ray laser diode, and existence of the identification yarn can be recognized by hearing with the alarm or the like which beeps upon detection of emission of the infrared rays of the specific wavelength, or can be recognized visually with the light-emitting device whose lamp is switched to another one upon detection of emission of the infrared rays of the specific wavelength. Moreover, infrared rays emitted from the identification yarn due to irradiation of infrared rays of a specific wavelength can be sensed by a CCD camera, and then its signal is processed, thereby emission of infrared rays of a specific wavelength can be detected. A specific wavelength of infrared rays irradiated to the identification yarn and a specific wavelength of infrared rays emitted from the identification yarn can be either identical with or different from each other, and forgery can be prevented effectively by setting the relationship between these specific wavelengths.

Additionally, various detection methods using recently developed infrared ray detectors can be used. Using such methods, anti-counterfeit effect can be enhanced by, for example, forming a pattern or the like in a tape with an identification yarn having optical characteristic based on infrared rays and complicating its detection method in order to cope with imitation fasteners with similar identification yarns. Moreover, even in such a case, the identification yarn can be detected if a detector corresponding to each condition is used.

What is claimed is:

1. A fastener selected from the group of a slide fastener, a surface fastener, and a snap fastener, comprising at least one identification yarn for distinguishing a genuine fastener from a false one, said identification yarn being located at no fewer than one specified position of a tape composing said fastener, and being recognized by irradiation of infrared rays of a specific wavelength, wherein said identification yarn is dyed the same color as other component yarns of the tape.

2. A fastener according to claim 1, wherein said tape is a woven tape whose component yarns are a plurality of warp yarns and weft yams and said identification yarn is part of said warp yarns, said identification yarn repeating a cycle of intersecting and running above one or two weft yarns and then intersecting and running below one or two weft yarns.

3. A fastener according to claim 1, wherein said tape is a knitted tape whose component yarns are plural kinds of warp knitting yarns, said identification yarn being a warp in-laid yarn inserted along a chain-stitch knitting yarn.

4. A fastener according to claim 1, wherein said tape is a knitted tape whose component yarns are plural kinds of warp knitting yarns, said identification yarn being part of chain-stitch knitting yarns.

5. A fastener according to claim 1, wherein said tape is a knitted tape whose component yarns are plural kinds of warp knitting yams, said identification yarn being part of tricot-stitch knitting yarns.

6. A fastener according to claim 1, wherein said specified position is adjacent a leg portion end of an element row of the slide fastener, and said identification yarn is a warp yarn or a warp knitting yarn and is disposed continuously along a position adjacent said leg portion end.

7. A fastener according to claim 1, wherein said identification yarn contains material emitting infrared rays of a specific wavelength under irradiation of infrared rays of a specific wavelength.

8. A fastener according to claim 1, wherein said identification yarn is part of component yarns of engaging elements of the tape of the surface fastener.

9. A fastener according to claim 1, wherein said identification yarn contains material emitting a different color from that of surrounding components under infrared-ray irradiation.

* * * * *